US006325211B1

(12) United States Patent
Greiner

(10) Patent No.: US 6,325,211 B1
(45) **Date of Patent: *Dec. 4, 2001**

(54) DECORATIVE CONTAINER AND METHOD FOR DECORATING A CONTAINER

(76) Inventor: Lori Greiner, 1301 Dearborn Pkwy., Suite 402, Chicago, IL (US) 60610

( * ) Notice: Subject to any disclaimer, the term of this patent is extended or adjusted under 35 U.S.C. 154(b) by 0 days.

This patent is subject to a terminal disclaimer.

(21) Appl. No.: 09/757,445

(22) Filed: Jan. 9, 2001

Related U.S. Application Data

(63) Continuation of application No. 09/586,153, filed on Jun. 2, 2000, now Pat. No. 6,253,918.

(51) Int. Cl.[7] ..... B65D 21/02

(52) U.S. Cl. ..... 206/457; 220/23.87; 220/528; 220/575

(58) Field of Search ..... D3/202; 40/312, 40/324, 722; 206/217, 423, 457; 215/10, 12.1; 220/4.01, 4.26, 23.83, 23.87, 506, 523, 528, 560.03, 573.4, 573.5, 574, 574.1, 574.3, 575, 588, 592.15, 592.17, 592.24, 601, 625, 787, 789, 796, 903; 426/112

(56) References Cited

U.S. PATENT DOCUMENTS

| | | | | |
|---|---|---|---|---|
| D. 260,219 | | 8/1981 | Blake et al. . | |
| D. 314,525 | | 2/1991 | Alward . | |
| 776,363 | | 11/1904 | Snyder . | |
| 1,263,391 | | 4/1918 | Eickemeyer . | |
| 1,332,019 | * | 2/1920 | Allison | 220/573.4 |
| 1,965,028 | * | 7/1934 | Bissell | 215/12.1 |
| 2,096,825 | * | 10/1937 | Roman | 220/575 |
| 2,213,837 | | 9/1940 | Gill . | |
| 2,719,413 | | 10/1955 | Panzer . | |
| 3,378,134 | | 4/1968 | Wilkinson et al. . | |
| 3,776,413 | | 12/1973 | Myers . | |
| 3,992,811 | | 11/1976 | Yellin . | |
| 4,001,959 | | 1/1977 | Grendahl . | |
| 4,195,729 | * | 4/1980 | Macken | 40/722 |
| 4,273,245 | | 6/1981 | Machalek . | |
| 4,457,103 | | 7/1984 | Aloziem . | |
| 4,756,446 | | 7/1988 | Gen et al. . | |
| 4,789,073 | | 12/1988 | Fine . | |
| 4,891,032 | | 1/1990 | Davis . | |
| 4,928,412 | | 5/1990 | Nishiyama . | |
| 4,951,832 | * | 8/1990 | Tenney et al. | 220/23.83 |
| 4,979,325 | | 12/1990 | White . | |
| 5,036,998 | | 8/1991 | Dunn . | |
| 5,040,317 | | 8/1991 | Kadjevich . | |
| 5,148,682 | * | 9/1992 | Wolf | 220/903 |
| 5,275,277 | | 1/1994 | Gallegos . | |

(List continued on next page.)

OTHER PUBLICATIONS

Brochure, "a hint of summer cool it down", *ampersand*, and "Description of Previously Marketed Product On Sale Prior to Invention by Applicant", 2 pp.

Magic Bowl product (also called DecoBowl), sold on Home Shopping Network at least as early as Oct. 30, 2000. Photograph. Product Information Sheet, and video of on–air demonstration on Home Shopping Network on Oct. 30, 2000.

*Primary Examiner*—Jim Foster
(74) *Attorney, Agent, or Firm*—Merchant & Gould P.C.

(57) ABSTRACT

A decorative container for displaying items in internal cavities includes an inner container and an outer container, defining a hollow region therebetween. The decorative container further includes a plurality of dividers within the hollow region separating the region into a plurality of internal cavities. The outer container further includes a removable plate, configured to provide access to each of the internal cavities, so that decorative objects within the internal cavities can be easily changed or rearranged. A method for decorating a container includes placing objects within the hollow region through an access opening and closing the access opening with a removable plate.

30 Claims, 6 Drawing Sheets

U.S. PATENT DOCUMENTS

| | | | | |
|---|---|---|---|---|
| 5,300,748 | | 4/1994 | Colombo . | |
| 5,419,856 | | 5/1995 | Shaw . | |
| 5,553,735 | | 9/1996 | Kimura . | |
| 5,687,497 | | 11/1997 | Moore . | |
| 5,709,168 | | 1/1998 | Walker . | |
| 5,772,063 | | 6/1998 | Gantz-Bloome . | |
| 5,807,156 | | 9/1998 | Owen . | |
| 5,807,597 | * | 9/1998 | Barnes et al. | 426/234 |
| 5,829,626 | | 11/1998 | Brennan . | |
| 5,839,599 | | 11/1998 | Lin . | |
| 5,894,948 | | 4/1999 | Yeh . | |
| 6,065,609 | * | 5/2000 | Lake | 206/217 |
| 6,116,455 | * | 9/2000 | Rossman et al. | 220/575 |

* cited by examiner

DECORATIVE CONTAINER AND METHOD FOR DECORATING A CONTAINER

This application is a continuation of application Ser. No. 09/586,153, filed Jun. 2, 2000, now U.S. Pat. No. 6,253,918, which application is incorporated herein by reference.

FIELD OF THE INVENTION

The present invention is directed to an arrangement for a decorative container, more particularly to a decorative container including a hollow region where objects can be displayed, and to a method for decorating a container.

BACKGROUND OF THE INVENTION

Decorative containers are known in the prior art that allow sheets of material or objects to be stored within the walls of the container. For example, beverage mugs are known in the art that provide space for a sheet of material, such as decorative paper or a photo, in the wall of the mug. These types of mugs sometimes provide a removable portion so that the sheet of material may be changed by the user. Most of these types of beverage mugs in the prior art accommodate a thin sheet of material, like a photo, although some of these decorative mugs may allow for insertion of liquid or fine particles within the space provided for decoration or information display.

However, there is a need for arrangements especially situated to hold three-dimensional decorative objects within the walls of the container that can be easily changed. There is also a need for an arrangement where a number of internal cavities are provided for separating the decorative objects, to provide attractive separation and placement of decorative objects.

SUMMARY OF THE INVENTION

Generally, the present invention provides a decorative container that displays items in internal cavities, the container comprising an inner container nested within an outer container thereby defining a hollow region therebetween. The decorative container ether includes a plurality of dividers within the hollow region that separate the region into a plurality of internal cavities. The decorative container also includes a removable plate that provides access to each of the internal cavities. Preferably, the inner and/or outer containers are bowl shaped and are transparent to provide viewing of the decorative objects within the internal cavities from all sides of the container. The plate that provides access to the internal cavities may be round and may fit into an opening in the outer container with a press fit configuration. Preferably, the plate fits into a bottom portion of the outer container and is removable without special tools.

In a preferred configuration, the hollow region has a thickness of at least about a quarter-inch apart, more preferably at least a half-inch apart, allowing room for positioning of decorative objects within the internal cavities. In one preferred configuration, the decorative container includes 15 vertical dividers that separate the region into 15 internal cavities. The decorative container may also include a circular divider at a bottom portion of the hollow region, defining a circular display area. The circular display area is preferably also accessed through the bottom plate in the outer container.

A system of the present invention may also include a wand configured to assist with positioning items in the hollow cavities. The wand preferably has a rigid tip and a soft tip at opposing ends. Also the wand preferably has a somewhat flexible shaft to allow insertion of the wand into the internal cavities, which may be curved when the decorative container is bowl-shaped.

The present invention also includes a decorative bowl for displaying items in an internal hollow region including an inner bowl nested within an outer bowl defining the hollow region therebetween where the hollow region has a thickness of at least about one-quarter inch apart. The decorative bowl further includes a removable bottom plate in the outer bowl that provides access to the hollow region. The decorative bowl preferably further includes an upper rim covering the hollow region. The decorative bowl may include dividers within the hollow region defining internal cavities.

A method of the present invention for decorating a container, where the container includes a hollow region defined between an inner container and an outer container, includes the method steps of placing objects within the hollow region through an access opening in the outer container and closing the bottom access opening with a removable plate. The method may also include the step of placing objects in a plurality of internal cavities within the hollow region, positioning or removing objects using a wand, and removing objects within the internal cavities before filling the internal cavities with new objects.

BRIEF DESCRIPTION OF THE DRAWINGS

The invention may be more completely understood by considering the detailed description of various embodiments of the invention which follows in connection with the accompanying drawings.

Figure 1:
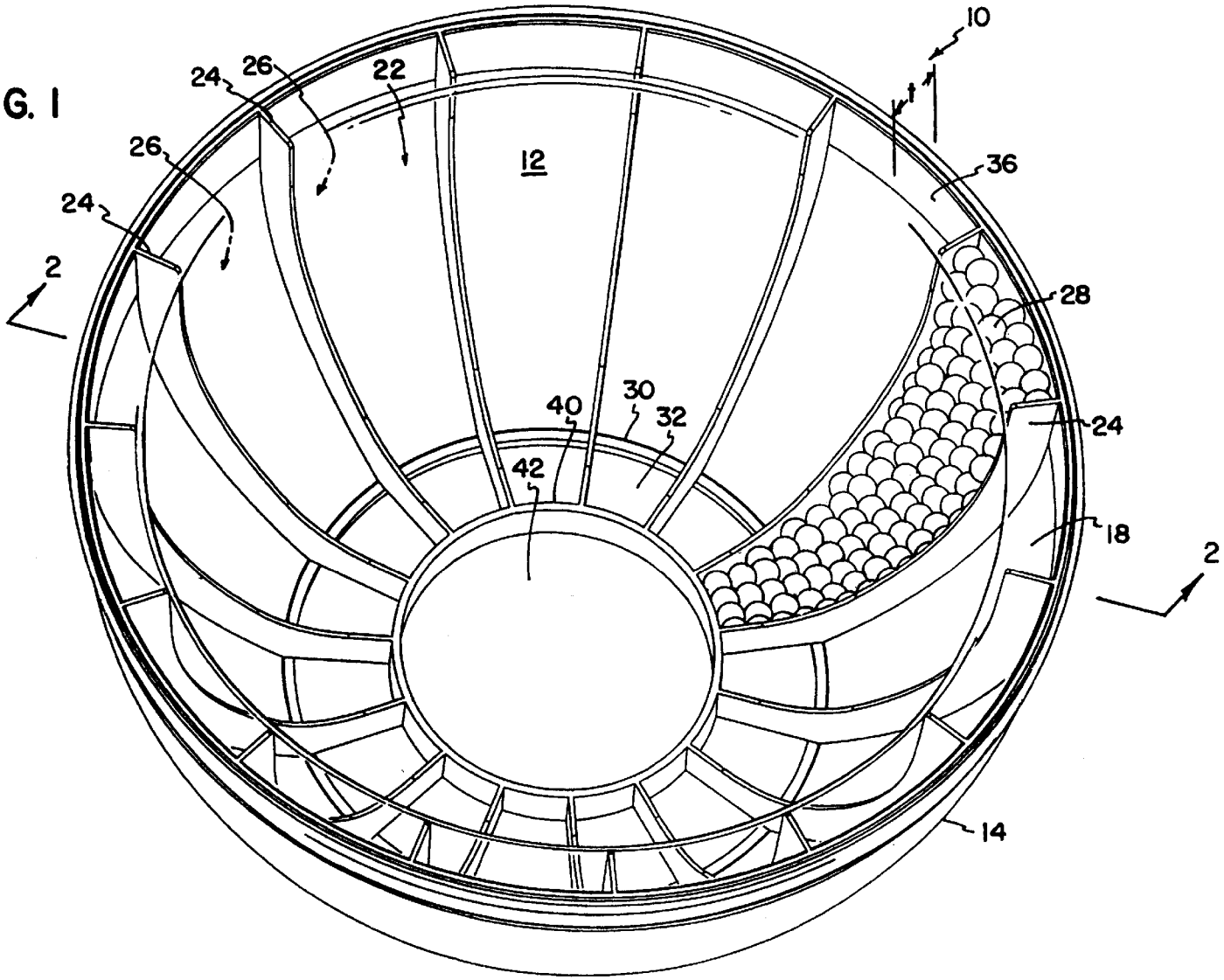
FIG. 1 is an isometric view of one embodiment of the decorative container of the present invention.

While the invention is amenable to various modifications and alternative forms, specifics thereof have been shown by way of example in the drawings and will be described in detail. It should be understood however that the intention is not to limited the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

The present invention is believed to be applicable to a variety of systems and arrangements for displaying decorative objects in a container that can be used to hold items in the inner open area of the container and a method for decorating a container. The invention has been found to be particularly advantageous where it is desired to display different types of three-dimensional objects in a format such that the arrangement of the decorative objects and the content of the decoration can be easily changed to suit different circumstances. The invention is also especially useful where it is desirable to display several different types of decorative objects in separate internal cavities of a decorative bowl. While the present invention is not so limited, an appreciation of various aspects of the invention is best gained through a discussion of an example operating in such an environment FIG. 1 illustrates one particular embodiment of the decorative container of the present invention where the decorative container 10 is bowl shaped and where the container is transparent The container 10 includes an inner container 12 and an outer container 14. The inner container 12 is nested within the outer container 14 and is spaced from the outer container 14 to define a hollow region 18 therebetween. The inner container 12 may also defined an open area 22. In the preferred embodiment, the open area is sized to hold many different items such as salads, pasta, fruits, popcorn, snack food, candy, or potpourri, for example. A plurality of dividers 24 are positioned within the hollow region and separate the hollow region into several internal cavities 26. The internal cavities may store different types of decorative items 28, providing an appealing visual display by permitting separation of the different types of decorative items 28.

Figure 2:
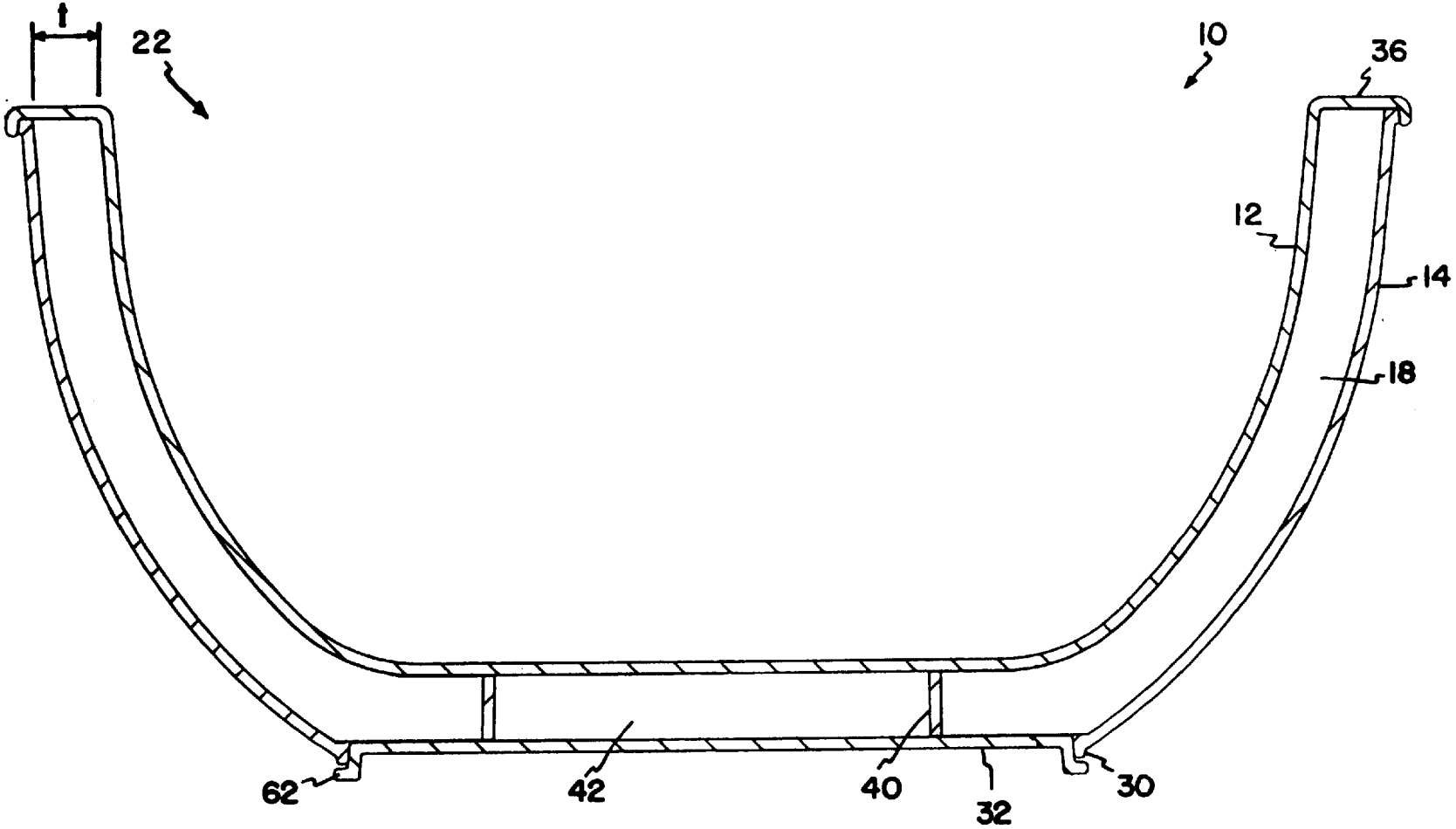
FIG. 2 is a crossectional view of the decorative container shown in FIG. 1 taken along line 2—2.

Now referring to FIG. 2, at the base or bottom portion of the outer container, an access opening 30 is defined. A removable plate 32 fits within the access opening 30 and is configured to provide access to each of the internal cavities 26. In a preferred embodiment, the removable plate is situated in the bottom of the outer container. The removable plate will be referred to throughout as a bottom plate, although other configurations are possible. The removable plate may alternatively be removable from portions of the container 10 other than the bottom. For example the plate could be an annular shaped plate removable from an upper rim of the container to provide access to the internal cavities. Preferably, the bottom plate 32 may be pressed firmly into position in the access opening 30 by band or using a heavy object to apply pressure. It is also preferable that the bottom plate 32 can be easily pried off the access opening 30 by hand.

The top of the decorative container 10 may include a rim or upper rim 36 that closes the internal cavities 26 from the outside environment. Therefore the internal cavities are not open to allow unwanted items to accidentally fall into the internal cavities during normal use. In a preferred embodiment, the upper rim 36 is an integral part of the inner bowl 12. Alternatively, the upper rim 36 may be a separate piece or may be integral with the outer bowl 14.

A circular divider 40 is shown at the bottom of the hollow region 18, defining a circular display area 42. The circular display area 42 is also shown in FIG. 1 and may be viewed from above the inner container at the bottom of the bowl.

Figure 3:
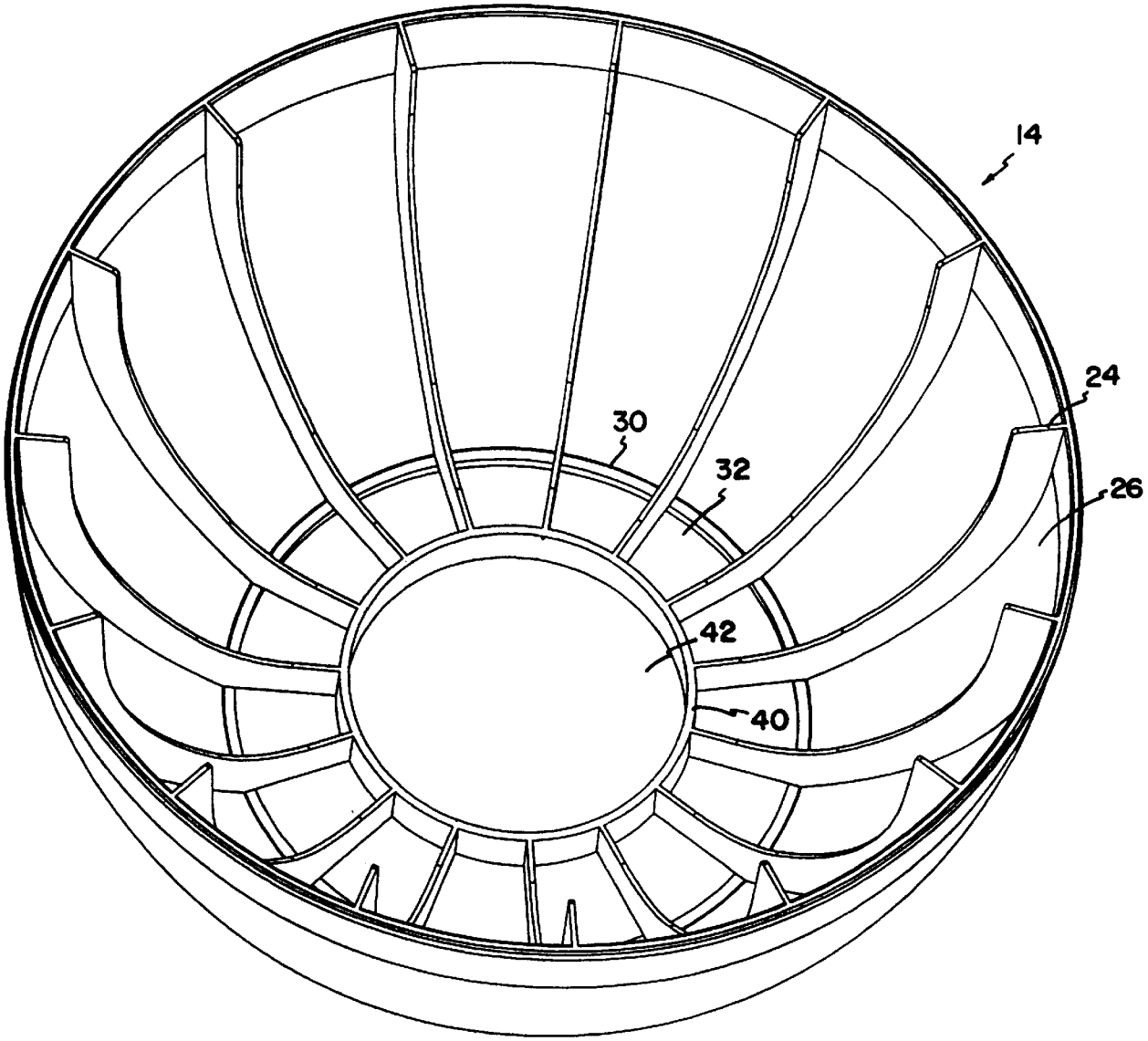
FIG. 3 is an isometric view of an outer container that is a component of the decorative container of FIG. 1.

FIG. 3 is an isometric view of the outer container 14 of the present invention. The outer container 14 includes dividers 24 separating the surface of the outer container into a plurality sections. These sections will form the internal cavities 26 when the inner container 12 is attached. The outer container 14 has an access opening 30. The access opening 30 mates with the bottom plate 32 to close the hollow region 18.

Figure 4:
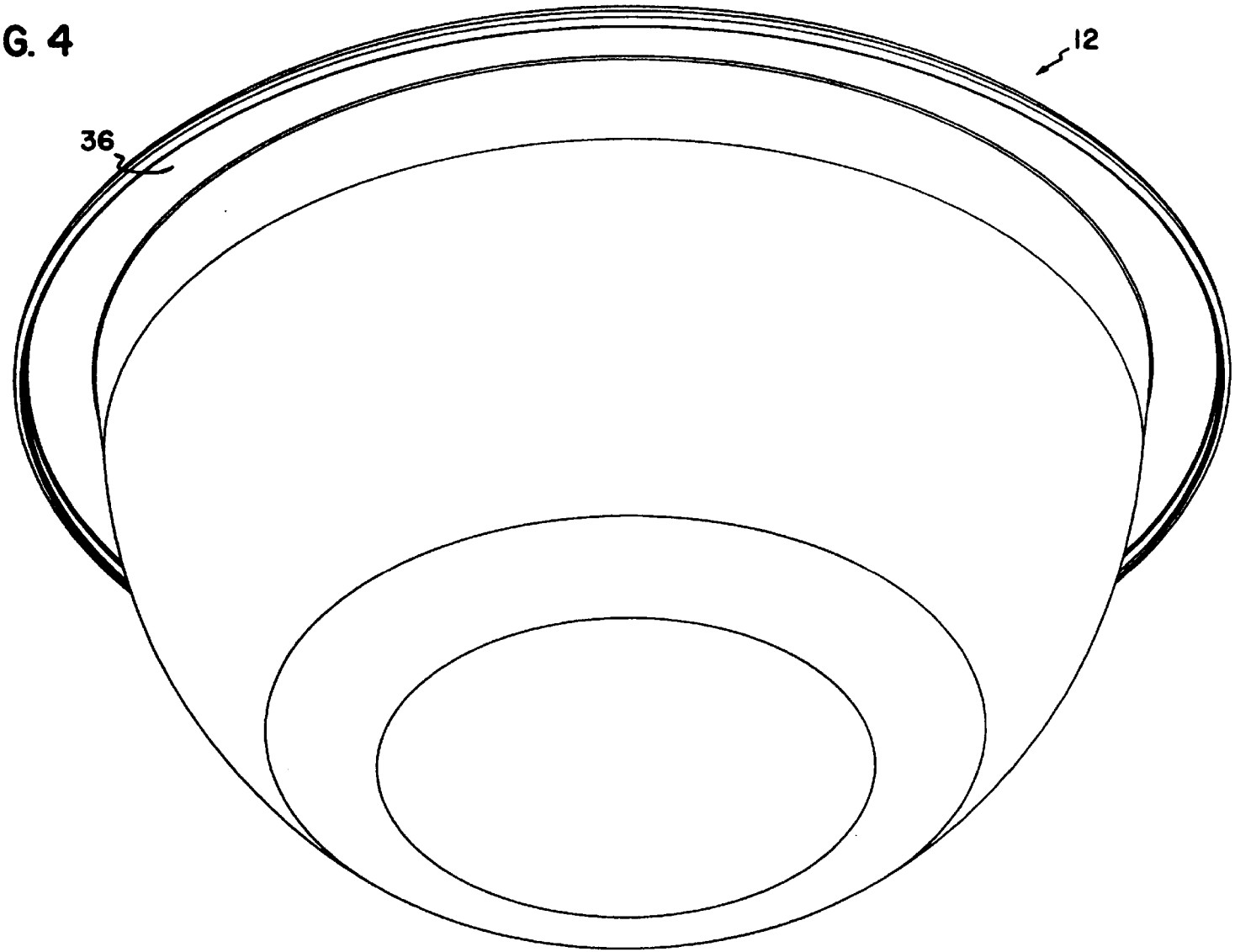
FIG. 4 is an isometric view of an inner container that is a component of the decorative container of FIG. 1.

FIG. 4 is an isometric view of an inner container 12 of the present invention. The inner container nests within the outer container 14 to define a hollow region 18 between the two containers. In one embodiment, the inner container 12 includes a rim 36 that provides the top closed surface of the decorative container 10. It is also possible that a rim is provided on the outer container 14, or a rim may be a separate piece of the container 10. Further, other arrangements are possible, including a container 10 without an upper rim or a removable upper rim to provide access to the internal cavities from the top of the container instead of the bottom.

Figure 5:
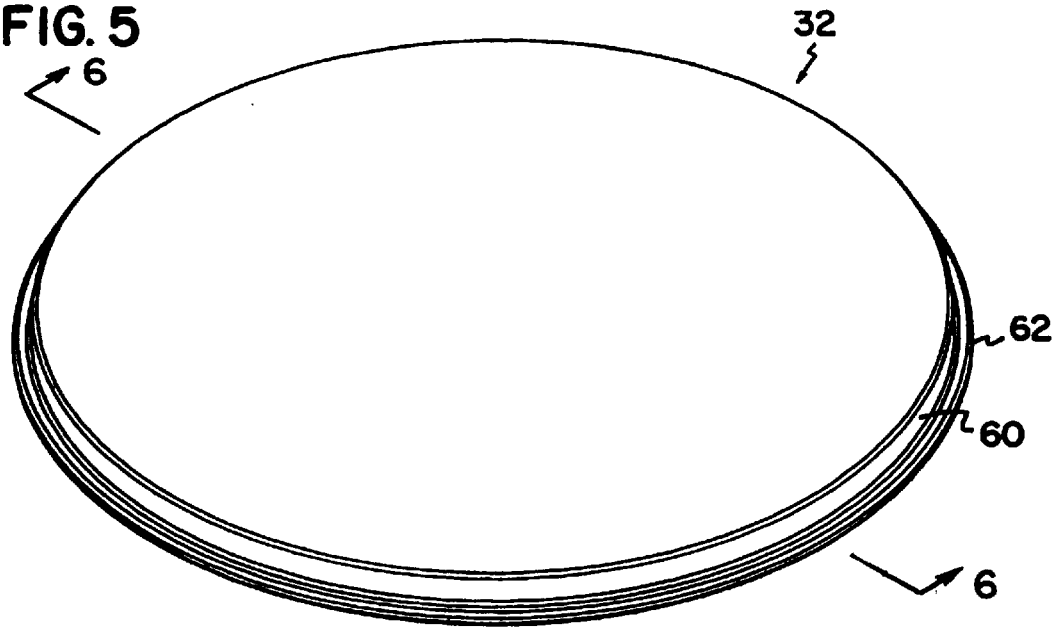
FIG. 5 is an isometric view of a bottom plate that is a component of the decorative container of FIG. 1.
Figure 6:
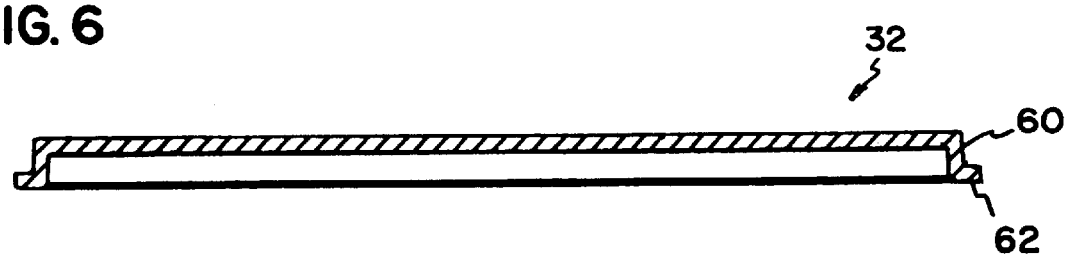
FIG. 6 is a crossectional view of the bottom plate of FIG. 5 taken along line 6—6.

FIGS. 5 and 6 show an isometric view and a cross-sectional view, respectively, of the bottom plate 32. The bottom plate 32 includes a plate rim 60 that engages the access opening 30 of the outer container 14. The plate rim 60 and the bottom plate 32 are preferably sized so that the bottom plate 32 fits tightly within the access opening 30, so that the bottom plate may be pressed firmly into the access opening 30 of the outer container 14 without any special tools and the bottom plate 32 will remain securely within the access opening 30 once it has been pressed into place.

The bottom plate 32 also includes a lip 62 that also engages the access opening 30 of the outer container 14. The lip 62 provides a structure to grab onto when the base plate 32 is manually removed from the outer container 14.

Preferably, the bottom plate 32 may be pressed into the access opening 30 and may be removed from the access opening 30 without any special tools, so that the decorative items within the hollow region can be replaced or reconfigured very easily. However, the plate 32 of the invention may be configured to mate with the access opening 30 in the outer container in many different ways and still be contemplated by the present invention. For example, the plate 32 could be provided with screw threads for mating with screw threads on the access opening 30 of the outer container, a snapfit configuration, a hinge and lock configuration or many other mating configurations that are known in the art.

The decorative container 10 may be provided in many different sizes, depending on the types of decorative items to be displayed and the types of food or other items to be placed in the open area 22. In one preferred embodiment, the container is bowl-shaped and the upper rim of the decorative container is circular and has a diameter of about 10 inches to about 14 inches, preferably about 12 inches. The base of the outer container may have a diameter in the preferred embodiment of about 4 inches to about 8 inches, preferably about 6 inches. The height of the bowl in a preferred embodiment is about 4 inches to about 8 inches, preferably about 6 inches. In this preferred embodiment, the hollow region between the inner and outer containers has a thickness, t, of at least about ¼ inch, more preferably at least about one half-inch, and most preferably about 0.56 inches. The width of the dividers provides this spacing. The decorative container could also have a canister shape. As mentioned above, many different placements and configurations of the access opening are possible. Where the decorative container is canister shaped, it is anticipated that the removable plate would fit into the upper rim of the decorative container, providing access to internal cavities within the walls of the canister. The decorative container may also be shaped as a tray with removable handles to provide access to internal cavities within the base of the tray.

The decorative container 10 may be constructed of many different materials that have adequate rigidity for storing items in the open area and for storing decorative objects in the internal cavities. Other desirable characteristics for the material of the decorative container are transparency, ease of manufacture, low cost, durability, washability, and visual attractiveness. Preferably, the components of the decorative container are made of the same material and are molded using well known techniques. Preferable materials for the decorative container include polystyrene and other plastic materials. Preferably, the inner and outer container are joined using an adhesive. However, the inner container and the outer container may be joined using one of many different attachment techniques known in the prior art.

Figure 7:
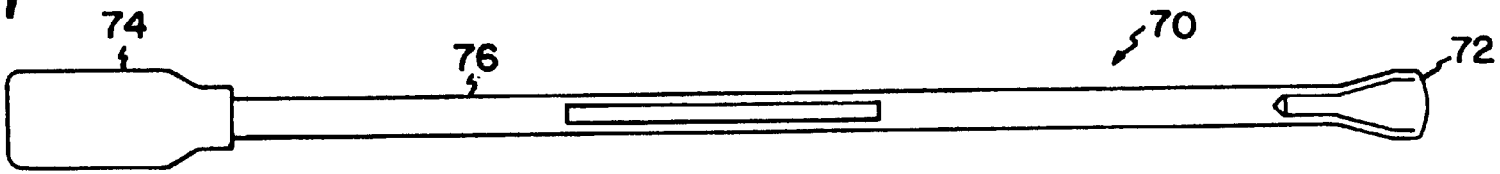
FIGS. 7, 8 and 9 are a top view, side view and bottom view respectively of a wand that may be used with the present invention.
Figure 8:
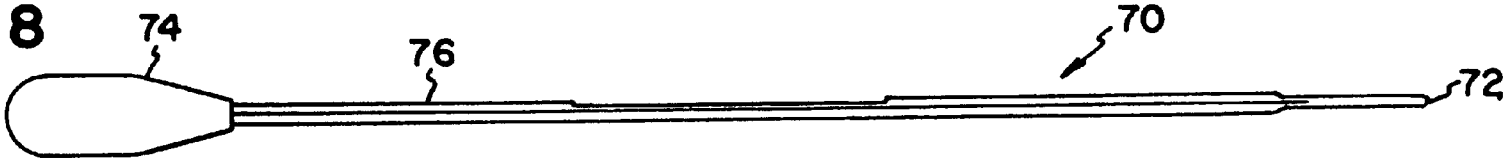
Figure 9:
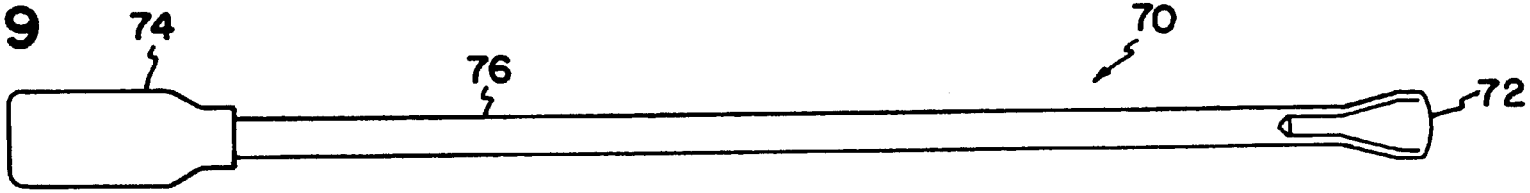

FIGS. 7, 8 and 9 show a wand 70 for use with the decorative container 10 of the present invention. The wand 70 may be useful for positioning decorative items within the internal cavities 26 of the decorative container. The wand may have a firm tip 72 at one end and a soft tip 74 at the other end for assisting with positioning the decorative items. The soft tip 74 may be made out of materials such as foam or cloth. The wand 70 also includes a shaft 76. The shaft 76 is preferably somewhat flexible so that the wand 70 can be used within the curved internal cavities of a bowl shaped embodiment of the decorative container 10 of the present invention.

Preferably, the wand is sized to be easily insertable into the internal cavities, and long enough to reach into the internal cavities. In one preferred embodiment, the wand is about six inches long, with a rigid tip about 5/16 inch wide and a soft tip about 7/16 inch wide and about one inch long. The wand is preferably made from a plastic material. Two wands may be used with the decorative container.

In the preferred embodiment of the decorative container 10, all components are made of a transparent material to allow viewing of the decorative objects from all angles. However, it is also possible and may be desirable to construct the decorative container 10 with only some portions transparent, such as only the inner container or only the outer container or portions thereof By transparent, it is meant that objects behind the material are at least somewhat visible to a viewer.

In addition, many different numbers and configurations of internal dividers are contemplated by the present invention. In a preferred embodiment of the decorative container 10, 15 dividers are equally spaced between the inner container 12 and the outer container 14, creating 15 internal cavities 26. It should be understood that many different numbers and spacings of dividers and internal cavities may be desirable and are encompassed by the present invention. It may be desirable to have at least seven internal cavities within the decorative container to allow for a variety of decorative items to be displayed. It is also possible that the dividers 24 may be differently configured than those shown. For example, the dividers in the Figures are planar, but the dividers could also be non-planar, such as having an s-shape.

The decorative container 10 of the present invention allows for custom design of a decorative bowl, so that the decorations may be suited for a personal gift or to a certain room's decor. The present invention is also useful for displaying seasonally oriented decorations because the removable bottom plate allows for ease in changing the decorative objects.

In order to decorate the decorative container of the present invention, the container is placed with the top rim 36 facing down with the bottom plate exposed, or otherwise situated so the removable plate is accessible. The plate is then removed from the outer container, providing access to each of the internal cavities and the circular display area within the hollow region. Then decorative objects are placed in the various internal cavities. The wand 70 may be used to assist with placement of the decorative objects. When the decorative objects have been arranged as desired, the plate is pressed back into place in the access opening, possibly using a heavy object to apply pressure to the plate. Alternatively, the bottom plate may be installed in the outer container in many different ways in alternative configurations, such as screwed into place or snapped into place. Once the access opening is closed, the decorative objects are securely contained within the internal cavities. In a preferred embodiment, the internal cavities are not open to the outside environment, thereby preventing unwanted items from entering the internal cavities. The decorative container 10 may then be turned over so that the base rim is facing downward and the open area of the decorative container may then be utilized.

When a change of the decorative items within the internal cavities is desired, the removable plate is removed and the three-dimensional objects are emptied from the internal cavities. The wand 70 may again be useful in urging all of the decorative objects out of the internal cavities. Now the decorative container is available for filling with different decorative objects.

The various embodiments described above are provided by way of llustration only and should not be construed to limit the invention. Those skilled in the art will readily recognize various modifications and changes which may be made to the present invention without strictly following the preferred embodiments and applications illustrated and described herein, and without departing from the true spirit and scope of the present invention which is set forth in the following claims.

What is claimed is:

1. A decorative container for displaying items in internal cavities, the container comprising:

an inner container nested within an outer container thereby defining a hollow region therebetween, wherein the outer container is symmetric about a vertical axis;

a plurality of dividers located within the hollow region to divide the hollow region into a plurality of inner cavities, each divider substantially the hollow region between the inner and outer containers; and a removable member configured to enable access to the hollow region upon removal.

2. The decorative containers of claim 1 wherein the inner and outer containers are transparent.

3. The decorative container of claim 1 wherein the inner and outer containers are bowl shaped.

4. The decorative container of claim 3 wherein the removable member is round.

5. The decorative container of claim 1 wherein the inner container defines an open area therein.

6. The decorative contain of claim 1 wherein the hollow region has a thickness of at least about one-quarter inch.

7. The decorative container of claim 1 wherein the hollow region has a thickness of at least about one-half inch.

8. The decorative container of claim 1 wherein the plurality of dividers is 15 dividers.

9. The decorative container of claim 1 wherein the removable member is press fit into an access opening defined in the outer container.

10. The decorative container of claim 1 wherein the removable member fits into an access opening located in a bottom portion of the outer container.

11. The decorative container of claim 1 wherein the removable member is removable without special tools.

12. The decorative container of claim 1 further comprising a circular divider at a bottom portion of the hollow region, defining a circular display area in the hollow region, wherein the circular display area is accessible by removing the removable plate.

13. The decorative container of claim 1 wherein the dividers are affixed to the outer container.

14. The decorative container of claim 1 further comprising a wand configured to assist with positioning items in the internal cavities.

15. The decorative container of claim 1 wherein the inner container is fixed to the outer container.

16. The decorative containers of claim 10 wherein the inner and outer containers are transparent.

17. The decorative container of claim 16 wherein the inner and outer containers are bowl shaped.

18. The decorative container of claim 17 when the removable member is round.

19. The decorative container of claim 18 wherein the hollow region has a thickness of at least about one-half inch.

20. The decorative container of claim 19 wherein the removable member is press fit into an access opening defined in the outer container.

21. The decorative container of claim 10 further comprising a wand configured to assist with positioning items in the internal cavities.

22. The decorative container of claim 10 wherein the inner container is fixed to the outer container.

23. The decorative container of claim 1 wherein each divider substantially spans the hollow region in a radial direction.

24. The decorative container of claim 10 wherein each divider substantially spans the hollow region in a radial direction.

25. The decorative container of claim 1 wherein each divider is in contact with the inner container and the outer container.

26. A decorative bowl for displaying items in au internal hollow region, comprising:

an inner bowl nested within an outer bowl thereby defining a hollow region therebetween, wherein the hollow region has a thickness of at least about one-quarter inch;

a plurality of dividers located within the hollow region to divide the hollow region into a plurality of internal cavities, each divider substantially spanning the hollow region between the inner and outer bowls;

a removable bottom member defining a portion of the outer bowl and configured to provide access to the hollow region.

27. The decorative bowl of claim 26 further comprising an upper rim extending between the inner and outer bowl.

28. The decorative bowl of claim 26, wherein the bottom member is configured to provide access to the internal cavities.

29. A decorative container for displaying items in internal cavities, the container comprising:

an out container;

an inner container nested within the outer container wherein a hollow region is defined by an outer wall of the inner container and an inner wall of the outer container, wherein the outer container is symmetric about a vertical axis;

a plurality of dividers located within the hollow region to divide the hollow region into a plurality of internal cavities, each divider substantially spanning the hollow region between the inner and outer containers; and removable access means for enabling access to each of the plurality of internal cavities upon removal.

30. The container of claim 29 wherein the means for enabling access comprises a removable plate.

* * * * *

UNITED STATES PATENT AND TRADEMARK OFFICE

CERTIFICATE OF CORRECTION

PATENT NO. : 6,325,211 B1
DATED : December 4, 2001
INVENTOR(S) : Greiner

It is certified that error appears in the above-identified patent and that said Letters Patent is hereby corrected as shown below:

Column 1,
Line 42, “ether” should read -- further --

Column 6,
Line 40, insert -- spanning -- after the word “substantially”

Column 7,
Line 15, “when” should read -- wherein --
Line 36, “au” should read -- an --

Signed and Sealed this

Thirteenth Day of August, 2002

*Attest:*

*Attesting Officer*

JAMES E. ROGAN
*Director of the United States Patent and Trademark Office*